US010375470B2

(12) United States Patent
Bisset et al.

(10) Patent No.: US 10,375,470 B2
(45) Date of Patent: Aug. 6, 2019

(54) COAXIAL CENTERBODY POINT-SOURCE (CCPS) HORN SPEAKER SYSTEM

(71) Applicants: Anthony Allen Bisset, Oakland, CA (US); Quang-Viet Nguyen, Aldie, VA (US)

(72) Inventors: Anthony Allen Bisset, Oakland, CA (US); Quang-Viet Nguyen, Aldie, VA (US)

( * ) Notice: Subject to any disclaimer, the term of this patent is extended or adjusted under 35 U.S.C. 154(b) by 0 days.

(21) Appl. No.: 15/775,500

(22) PCT Filed: Nov. 11, 2016

(86) PCT No.: PCT/US2016/061614

§ 371 (c)(1),
(2) Date: May 11, 2018

(87) PCT Pub. No.: WO2017/083708

PCT Pub. Date: May 18, 2017

(65) Prior Publication Data

US 2018/0359559 A1 Dec. 13, 2018

Related U.S. Application Data

(60) Provisional application No. 62/254,373, filed on Nov. 12, 2015.

(51) Int. Cl.

| | |
|---|---|
| ***H04R 1/24*** | (2006.01) |
| ***H04R 1/28*** | (2006.01) |
| ***H04R 1/30*** | (2006.01) |
| ***H04R 1/32*** | (2006.01) |
| ***H04R 9/06*** | (2006.01) |

(52) U.S. Cl.
CPC ..... *H04R 1/30* (2013.01); *H04R 1/24* (2013.01); *H04R 1/28* (2013.01); *H04R 1/2826* (2013.01); *H04R 1/32* (2013.01); *H04R 9/06* (2013.01)

(58) Field of Classification Search
CPC ..... H04R 1/30; H04R 1/24; H04R 1/2826
See application file for complete search history.

(56) References Cited

U.S. PATENT DOCUMENTS

| | | | |
|---|---|---|---|
| 4,283,606 | A | 8/1981 | Buck |
| 5,526,456 | A | 6/1996 | Heinz |
| 6,094,495 | A | 7/2000 | Rocha |
| 6,257,365 | B1 | 7/2001 | Hulsebus, II |
| 7,046,816 | B2 | 5/2006 | Vandersteen |
| 7,134,523 | B2 | 11/2006 | Engebretson |
| 2003/0053644 | A1 | 3/2003 | Vandersteen |

(Continued)

FOREIGN PATENT DOCUMENTS

| | | |
|---|---|---|
| GB | 303837 | 3/1930 |

OTHER PUBLICATIONS

US 5,411,718 A1, 06/2002, Danley et al. (withdrawn)

*Primary Examiner* — Sunita Joshi
(74) *Attorney, Agent, or Firm* — Hudak, Shunk & Farine Co. LPA

(57) ABSTRACT

The invention relates a horn-based multi-driver wide-bandwidth loudspeaker with a flat-frequency response having the property of controlled acoustic directivity at wavelengths larger than the nominal wavelength supported by the horns' mouth circumference which is provided by means of a centerbody fitted with acoustic drivers that are acoustically coupled to the walls of the horn enclosure.

36 Claims, 12 Drawing Sheets

Schematic of Coaxial Centerbody Point Source (CCPS) Horn Speaker System

(56) References Cited

U.S. PATENT DOCUMENTS

| | | | | |
|---|---|---|---|---|
| 2006/0285712 | A1* | 12/2006 | Butler | H04R 1/24<br>381/340 |
| 2011/0211720 | A1* | 9/2011 | Adams | H04R 1/30<br>381/339 |
| 2013/0121522 | A1 | 5/2013 | Flavignard et al. | |

* cited by examiner

Schematic of Coaxial Centerbody Point Source (CCPS) Horn Speaker System

Perspective View of CCPS Horn Speaker System from Figure 1

Schematic of Alternate Embodiment Employing Multiple Midrange Drivers

Schematic of Coaxial CCPS Horn Speaker System Employing a Bass Reflex Duct(s)

Schematic of CCPS Horn Speaker System Employing a Toroidal Ring Resonator and Feedback Duct(s) Topology Schematic of CCPS Horn Speaker System Employing a Sculpted Centerbody Profile to Control Dispersion (axial view from front of horn)

Schematic of CCPS Horn Speaker System Employed as a 2-dimensional Column in a Line Array with the Centerbody now having two primary walls.

Simulation of the CCPS Horn for a Sealed Rear Chamber Case

Simulation of the CCPS Horn for a Bass Reflex Rear Chamber Case

Simulation of the CCPS Horn for a Ring Resonator and Feedback Duct Case

Schematic of Alternate Embodiment Employing Tweeter and Midrange Drivers Housed in Centerbody Schematic of Alternate Embodiment with a Translating Centerbody to Effect Variable Directivity

COAXIAL CENTERBODY POINT-SOURCE (CCPS) HORN SPEAKER SYSTEM

FIELD OF THE INVENTION

The present invention relates to sound reproduction and more particularly to systems and methods to provide a horn-based multi-driver wide-bandwidth loudspeaker with a flat-frequency response having the property of controlled acoustic directivity at wavelengths larger than the nominal wavelength supported by the horns' mouth circumference, in other words, a compact wide-bandwidth multi-driver horn loudspeaker system.

BACKGROUND OF THE INVENTION

In accordance with the present invention a compact high fidelity multi driver point-source sound reproduction system is provided which is characterized by high efficiency, low distortion, wide bandwidth, and controlled directivity. Nearly all multi-driver loudspeakers work on the principle of acoustic summation to a point source representation at the listener's position. This can be seen in a number of common speaker configurations including home theater center channel speakers [Woofer-Tweeter-Woofer], in large format mastering speakers [Woofer-Mid-driver-Tweeter-Mid-driver-Woofer] in PA system line arrays which employ vertically stacked elements of [Woofer-High-Frequency-Source-Woofer] and in PA sound reinforcement systems where individual horns are aligned on one axis or co-axially nested, or more recently, horns that utilize multiple drivers integrated within a single horn to accomplish improved wavefront coherence and pattern control.

Most prior art related to the present invention is horn loudspeakers combining multiple drivers into a single source such as Mark Engebretson's Radiation Boundary Integrator (U.S. Pat. No. 7,134,523 B2), Thomas Danley and Bradford Skuran's Unity Summation Aperture (U.S. Pat. No. 6,411,718 B1), Richard Vandersteen's Coincident Source topology (US 20030053644 A1), Ralph Heinz's Multiple-Driver single horn loud speaker (U.S. Pat. No. 5,526,456 A) and Lee De Forest's invention titled "Improvements in or connected with sound reproducing devices" (GB 303,837 A) of 1930 which combines a high frequency reproducer and a low frequency reproducer through discrete throats which then merge into a common horn mouth.

Some of the above cited speaker systems are optimized for high sound pressure levels (horns), while others are optimized for wide dispersion (line arrays), while others are optimized for high-fidelity (mastering speakers); yet each of these loudspeaker topologies operates by summation of frequencies produced by multiple, bandwidth-specific (woofer, mid-range, tweeter, etc.), drivers used to accurately reproduce music at sound pressure levels sufficiently loud for listeners positioned at mid- or far-field and to satisfy audiences taking part in socially sanctioned rituals of induced hearing loss. In the case of multi-driver horn loud speakers, it has been possible to improve wavefront coherence beyond that of traditional discrete horn speakers, yet there remain a number of problems which limit their usefulness in professional applications.

The primary problem of multi-driver horn topologies is a "power response disparity" between the mid-range drivers and the high frequency ("HF") source, where the HF driver often times utilized is the so-called compression driver that is located at the horn vertex. This disparity is caused, in part, by the industry standard method of injecting the mid-range frequencies through the outer horn wall with the mid-range's upper bandwidth primarily defined by the acoustic distance between the injection point and the horn vertex. Because frequencies near ½ wavelength this distance suffer self-cancellation due to reflected sound waves, (from the mid-range driver to the compression driver's diaphragm and back to the mid-range driver's position), the midrange driver exhibits significant cancellation nulls at the fundamental ½-wave thus limiting the upper bandwidth available from the midrange driver element and forcing the high frequency driver to play to lower frequencies than are mechanically or acoustically optimal.

Furthermore, the usual practice of injecting the mid-range acoustic power into the horn is accomplished using an aperture or port located on the exterior wall of the horn. The mid-range drivers are coupled into the horn wall through a so-called band-pass chamber formed by the driver's diaphragm on one side and the horn wall and aperture on the other side. This band-pass assembly then is used to "inject" acoustic power into various locations of the horn's axial expansion by variation of the band-pass injection ports. The largest problem with this band-pass injection method is that the acoustic energy entering the horn's air mass goes through the sidewall port and into a sudden 2-$\pi$ steradian expansion. This sudden expansion has a large acoustic impedance discontinuity as the sound waves travel from mid-driver diaphragm, through a constricted band pass aperture and into the horn resulting in a mid-range driver which cannot efficiently couple its acoustic power into the horn's air mass (also known as "horn-loading") at higher frequencies, which is only possible if there is a coherent pressure expansion along the horn's axis. Since both these problems affect the mid-range drivers high frequency bandwidth (and quality thereof) it has become accepted that band pass aperture-loaded mid-range drivers are not used above 1500 Hz, but more often not used above 1200 Hz-1400 Hz, thus forcing the high frequency compression driver, (located at the horn vertex), to operate into significantly lower bandwidth than would normally be advisable for high power sound reinforcement applications. Such a multi-driver horn loudspeaker relies heavily on its HF compression driver which is then forced to operate at great sound pressure level ("SPL") which increases air turbulence and non-linear heating of the air medium within the compression driver's passages, thereby producing increasing levels of acoustic distortion, often characterized by the level of harmonic distortion. This high power requirement for the compression driver also results in increased mechanical fatigue and statistically increased failure rates as compared to compression drivers tasked with operating across less bandwidth starting at higher frequencies.

Another problem with current multi-driver horn topologies is that of wavefront interference and diffraction in arrayed (sectoral, cellular, cluster, line, etc.) speaker systems. Because of the difference between the horn's angle of acoustic expansion and the angle of its outer walls, a compromise must be made between increased mouth edge diffraction and spacing the array to form a coherent point source. This is because multi-driver horn topologies place the mid-range and bass speakers on the outside of the horn wall which makes the external enclosure geometry significantly larger than the embedded horn's acoustic geometry. For the case where forming a larger point source speaker system from a plurality of horns whose acoustic expansions are not the same angle as their external form factor, designers must separate the horns by 20 to 30 cm to make room for the bulky externally mounted drivers, and this extra separation between adjacent speakers incurs a reduced acoustic coupling between the horn mouths, and increased distortion via diffraction at the horn mouth(s). In the case where acoustic system designers couple these horn mouths together directly, the angle of co-incidence between the arrayed horns causes overlapping coverage which produces comb filtering, (overlapping bands of constructive and destructive interference which reduce signal fidelity). This is typically accounted for by adding extensions or round-overs to each multi-driver horn mouth which increases the physical dimensions of the horn or array of horns, thereby reducing their fit for use by sound-for-hire companies that transport speakers to locations and by venues where space is limited.

Yet another problem is the loss of horn directivity and loading/sensitivity at frequencies below the horn's rated low corner. In multi-driver horns, the mid-bass (150 Hz-300 Hz) and bass (10 Hz-150 Hz), bandwidth is compromised in usefulness because it does not exhibit pattern control like the majority of the horn speaker's bandwidth. Without pattern control across all frequencies reproduced, arrays will exhibit audible interference patterns. Further, without pattern control a positional amplitude response disparity between horn-uncoupled frequencies (bass and mid-bass) and horn loaded frequencies (mid-range and HF) will increase in severity as the listener's distance from the loudspeaker increases, making a flat frequency response loudspeaker which maintains relative spectral balance from near to far field impossible to achieve.

Lastly a problem known as "HF lobing" is caused by high frequency energy focusing along a horn's axis and producing an uneven or "lobed" spatio-frequency response. This results in a sound field where the frequency response changes as the listener comes directly on axis to the speakers' output. In sound reinforcement where arrays of horn speakers are used, the resulting uneven acoustic terrain becomes problematic when the audience is moving in the listening space or when the sound system is moving relative to the audience. Such HF lobing effects undermine the uniform pattern of directivity which is desirable in commercial or professional sound reinforcement applications where the listener or audience may not be stationary.

The present invention solves these problems by:

- Eliminating the "power response disparity" between the mid-range drivers and HF compression driver through efficient wide bandwidth acoustic coupling between the mid-range driver and the main horn air mass;
- Reducing the external footprint of the horn improving performance of point and line source arrays by locating the mid-range drivers internally to the exterior horn walls;
- Defining the exterior of the horn cabinet the same as the interior acoustic expansion surface thereby allowing speakers to be accurately placed in an array next to each other without directivity or mouth diffraction issues incurred by exterior cabinet construction which makes precisely arrayed acoustic alignments impossible;
- Allowing directivity to frequencies below the horns acoustic dimensions, whereby the pattern control applies to all frequencies is intentionally reproduced;
- Diminishing the on axis HF and Mid-Frequency ("MF") lobing, thereby solving the "HF lobing" problem;
- Enabling mid-range drivers to be integrated at closer proximity to the central horn vertex where the compression driver is located, thereby achieving improved summation of all audible frequencies and more precise point source behavior.

SUMMARY OF THE INVENTION

The present invention employs a novel centerbody fitted with acoustic drivers, and the centerbody resides within an external horn wall structure to provide a conical and annular topology which permits the phase-accurate integration or summation of 2 or more distinct acoustic sources by utilizing a high frequency driver at the vertex of horn assembly, and the mid-range driver at a location axially displaced along the direction of sound propagation towards the mouth of the horn. The location of the mid-range driver acoustic power injection is located at a point along the annulus, before the termination of the centerbody, whereby the annular acoustic channel forms into a unified flow. In the preferred embodiment, a high frequency compression driver is located at the vertex of the horn and the mid-range and mid-bass signal sources or resonators are located inside the center-body structure occupying the horn forming an expanding annular acoustic path. A new multi-segment annular acoustic lens horn profile was developed to effect variable acoustic output directivity.

The advantages of the present invention's center-body mid-range and bass injection method a six-fold over present state of the art methods for summation, combinatory or co-axial nested horns.

1. It is a primary objective of the present invention to utilize the mid-range drivers to inject acoustic power into a thin annulus formed by the interior surface of the exterior horn wall and the exterior surface of the wall of the centerbody, thereby enabling the mid-range drivers to fully "horn load" and reach frequencies greater than 3 kHz, typically 5 kHz, and as high as 10 kHz, allowing the critical vocal region to be covered by a single driver or set of mid-range drivers.
2. It is yet another objective of this invention to allow the HF driver output to be tuned or optimized by the geometry of the center-body to provide the functional equivalent of a phase plug to affect a more uniform, flatter, frequency and polar response without a significant on-axis HF lobe.
3. It is yet also another objective of this invention to enable the HF driver to operate at frequencies greater than 3 kHz in order to reduce diaphragm motion and compression chamber turbulence, thus increasing the SPL potential and reducing damaged diaphragms so common in the professional audio/sound reinforcement ("PA/SR") industry.
4. It is also another objective of this invention to provide for the mid-range and/or bass driver element(s) to be arranged in such a way as to provide a ring-resonator within the centerbody with low frequency ("LF") output integrating via a duct on the centerbody or transported to an inward facing duct located on the exterior horn wall via hollow vanes connected to the centerbody. This methodology produces directional horn loaded output at frequencies below the horn's normally defined acoustic specifications.
5. It is also another objective of the preferred embodiment of this horn speaker to not have any drivers on the exterior wall, thereby allowing more compact arrays which have improved phase/power response with reduced comb filtering and diffraction artifacts as compared to previous state of the art solutions.
6. Finally, it is also another objective of the present invention to utilize a novel horn profile that is calculated to specify stepped, linear or curved horn wall and centerbody wall profiles which produce a constant directivity for the wavelengths traversing the horn.

DETAILED DESCRIPTION OF THE DRAWINGS

Figure 1:
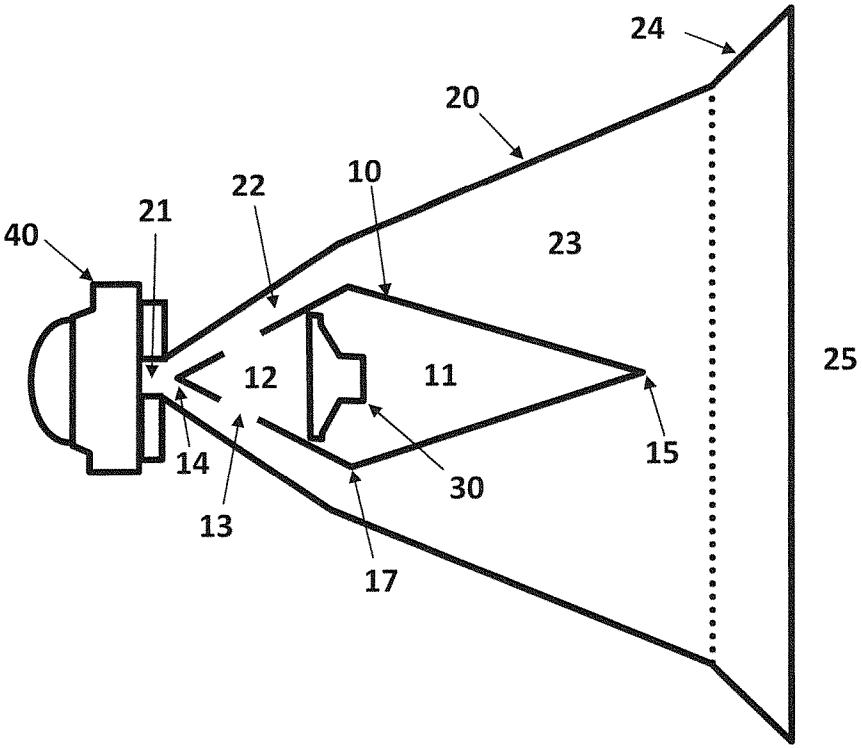
FIG. 1 is a side schematic representation of a coaxial centerbody point source ("CCPS") horn speaker system in accordance with the present invention.

FIG. 1 is a side view of a schematic representation of a coaxial centerbody point-source ("CCPS") horn speaker system in accordance with the first embodiment of the invention. The basic topology of CCPS horn speaker system comprises a central member, which is more specifically a centerbody 10 affixed (or positioned by thin members such as struts or a 'spider vanes' not shown for clarity) to the walls of an outer horn 20 such that the centerbody 10 is coaxially positioned within the horn to provide a narrow cross sectional annular passage 22 that expands to a larger cross sectional annular passage 23 that in turn expands into a unified flow at the secondary expansion 24 of the horn mouth 25.

The centerbody 10, contains one or more dynamic mid-range speaker driver 30 that define a rear chamber 11, and front chamber 12, and has a single or multiple pressure injection apertures 13 that allow communication of the air flow from the front chamber 12 to the annular passage 22, whereby the air contained in the rear chamber 11 is sealed. The extent of the centerbody 10 starts at the nose 14 (i.e., the "proximal vertex") and flows past the apex 17 and then extends to the tail 15 (i.e., the "distal vertex") and flows beyond the tail 15 to combine into a unified flow. A high frequency ("HF") acoustic transducer or driver 40 is attached to vertex of the outer horn 20 at the horn throat 21 such that the HF driver 40 acoustic output is in communication with the annular passage 22. Note that the front chamber 12 although shown as a rather large volume for the purposes of clarity, can be made to have an arbitrarily small volume by use of volume filler passage inserts within the front chamber 12 to permit a higher frequency extension of the acoustic output of the mid-range driver 30. The axial location and size of the aperture(s) 13 are chosen such that the acoustic output of driver 30 and HF driver 40 combine in a time and phase-aligned manner, such that their combined phase-coherent and time-aligned acoustic output continues to expand in the annular channel 21 and 23, and final expansion 24, whereupon the acoustic output radiates as sound into free-space at the horn mouth 25.

in accordance with the invention, the use of a narrow, (or high aspect ratio), annular channel between the outer horn walls and the centerbody walls allows an increase in the operating frequency of the crossover between the mid-range and the high-frequency drivers. This permits higher power levels to be used while reducing distortion in the high frequency driver.

Figure 2:
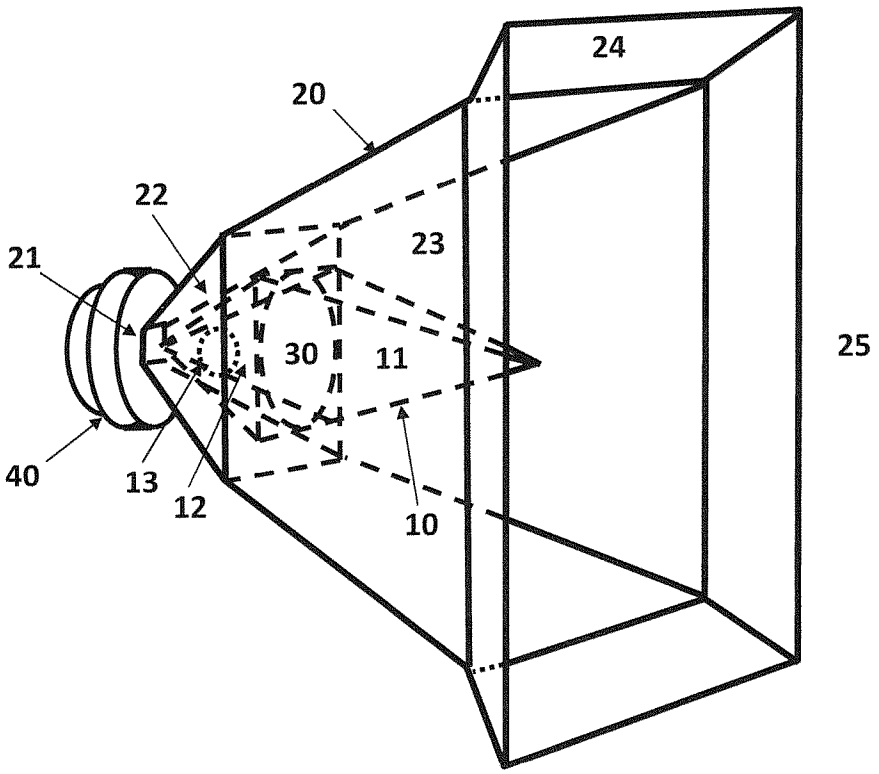
FIG. 2 is a perspective view of the horn speaker system as shown in FIG. 1.

FIG. 2 is a perspective view of the schematic representation of the CCPS horn speaker system in accordance with the first embodiment of the invention.

Figure 3:
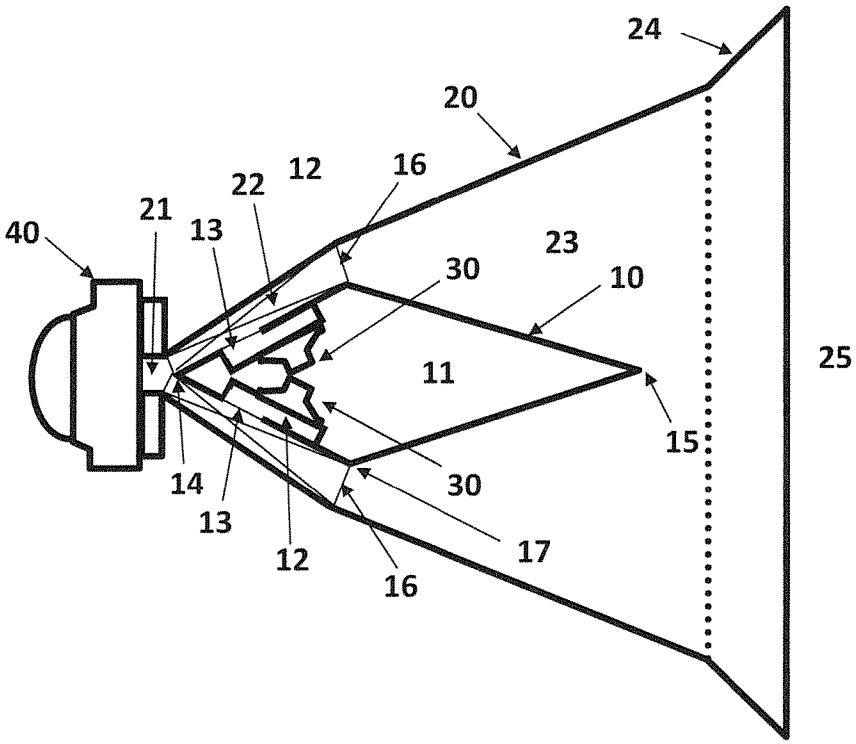
FIG. 3 is a side schematic representation of a second embodiment of the CCPS horn speaker system of the present invention which employees multiple mid-range drivers.

FIG. 3 is a side view of an alternate embodiment of the CCPS horn speaker system that employs a plurality of mid-range drivers 30, each connected to a plurality of front chambers 12, and a plurality of mid-range injection apertures 13 corresponding to each separate front chamber 12. Supporting struts 16 or spider vanes are used to support the centerbody 10 coaxially within the main horn 20. These supporting spider vanes 16 or struts would be connected along the exterior corner edges of the centerbody 10 between the nose 14 and apex 17 or point of largest diameter of the centerbody 10. The struts 16 also serve as a flow separator to keep the passages formed between the nose 14 and apex 17 separate for each driver 30 and front chamber 12 and injection aperture 13 system associated with each passage defined along the axial direction of the horn 20.

Figure 4:
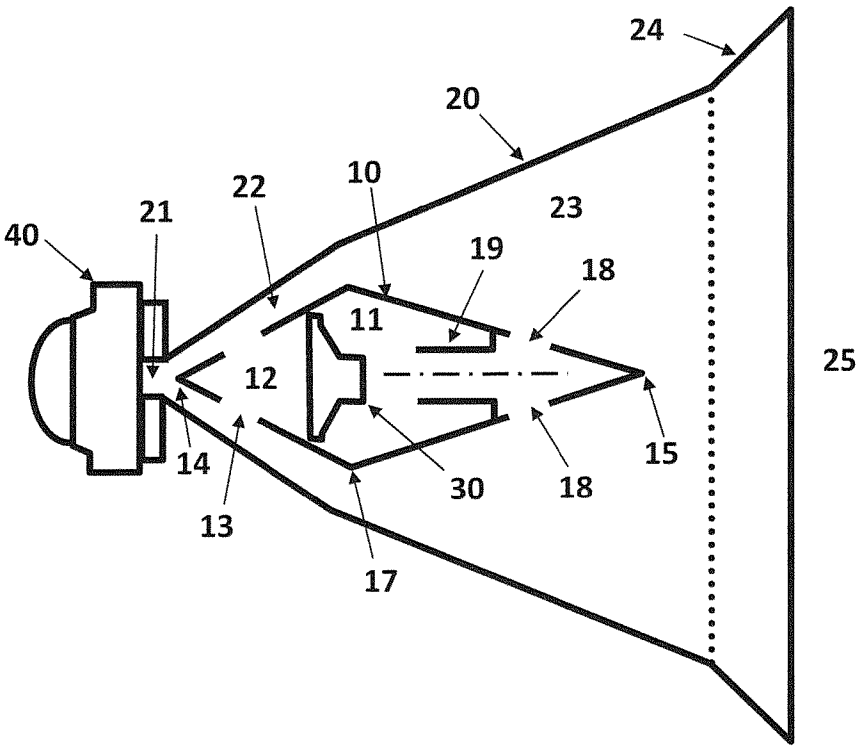
FIG. 4 is a side schematic representation of a CCPS horn speaker system of the present invention which employs a bass reflex duct.

FIG. 4 is a side view of a third embodiment of the CCPS horn speaker system that employs one or more bass reflex duct 19 that is in communication with the rear chamber 11 and annular flow passage 23 through bass reflex duct apertures 18 which may be radially placed along the walls of the centerbody 10 between the apex 17 and tail 15. The bass reflex duct 19 may also exit directly where the tail 15 is forming a coaxial duct located at the axis of the centerbody 10. The bass reflex duct 19 serves to provide a 4th order speaker alignment that extends the tuning range of the mid-range driver 11 to a lower frequency by supplementing the output from the apertures 13 with the bass output through the reflex duct 19.

Figure 5:
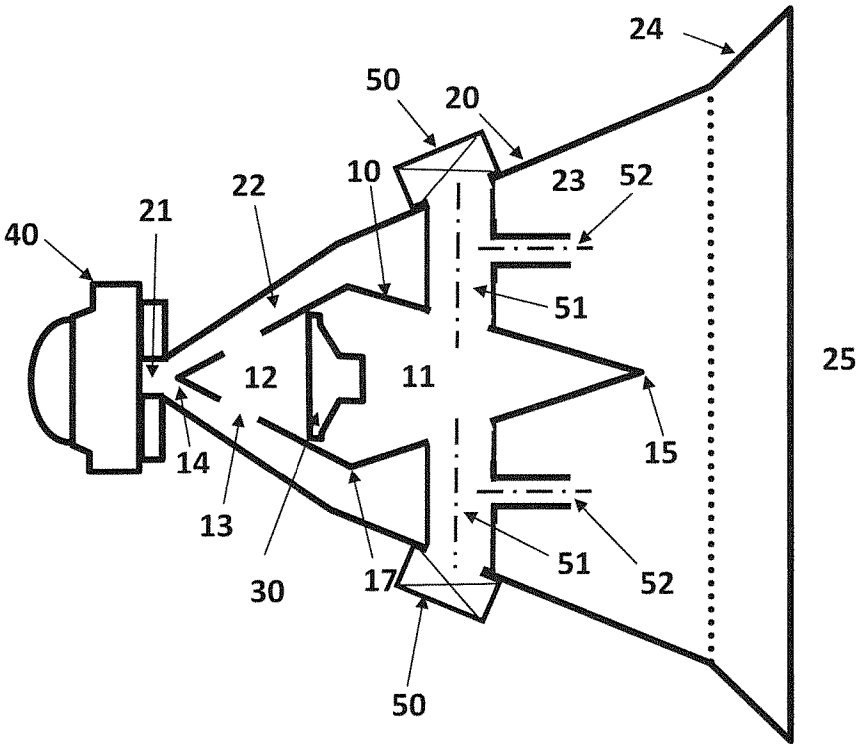
FIG. 5 is a side schematic representation of a CCPS horn speaker system employing a toroidal ring resonator and feedback duct topology.

FIG. 5 is a side view of a fourth embodiment of the CCPS horn speaker system that utilizes the novel ring resonator topology from Bisset and Nguyen (U.S. Pat. No. 9,479,861 B2) where a toroidal ring resonator 50, is in communication with one or more connector duct 51 between the ring resonator 50 and the rear chamber volume 11 of the centerbody 10. The ring resonator connector ducts (or duct) 51 are then in communication with feedback duct(s) 52. This particular embodiment provides additional bass extension beyond the traditional ¼-wave length of the main horn's axial distance.

Figure 6:
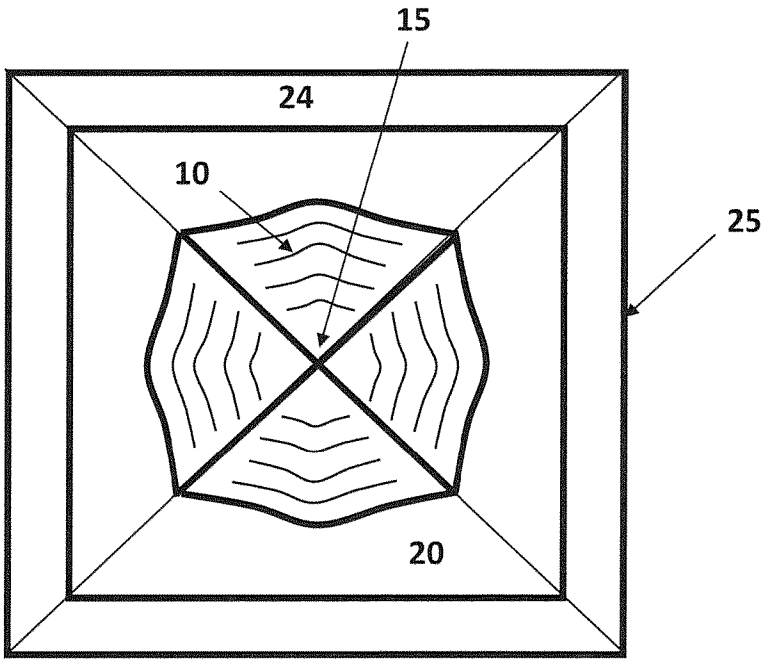
FIG. 6 is a front axial schematic representation of a CCPS horn speaker system employing a sculpted centerbody profile to control dispersion.

FIG. 6 is a front (end) view of an alternate embodiment in accordance with the invention where the centerbody member 10 has exterior surfaces or walls and an exterior apex 15, that have a sculpted 3-dimensional contour that is computationally designed to work in conjunction with the main exterior horn walls 20 and expansion 24 and mouth 25, to effect the directivity control of the horn. By doing so, a more uniform polar response pattern may be obtained.

Figure 7:
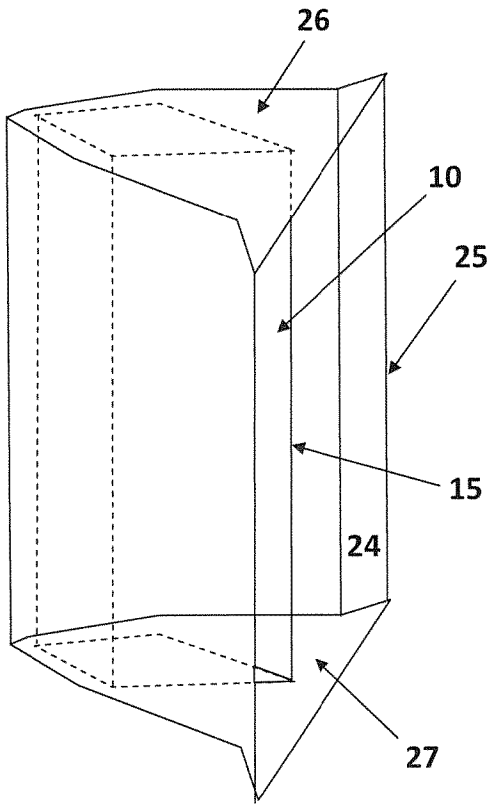
FIG. 7 is a perspective schematic of a CCPS horn speaker system employed as a 2-dimensional column in a line array with the centerbody having two primary walls.

FIG. 7 shows a perspective view of fifth embodiment of the present invention where the main horn walls 20 and centerbody are comprised of similar profiles in 3-dimensions but elongated to form a line-array type of speaker with the top wall 26, and bottom walls 27, forming the closed ends of the horn.

Figure 8:
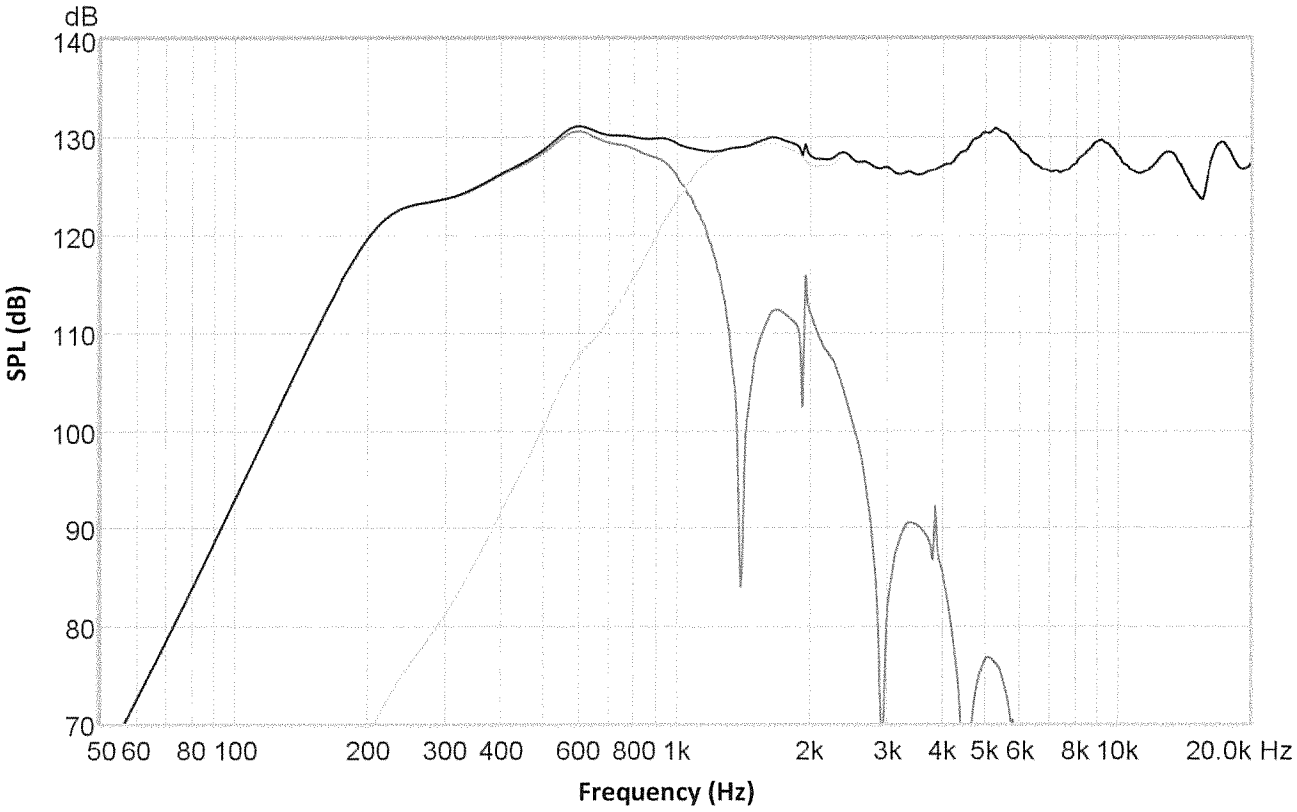
FIG. 8 is a graph illustrating a simulation of the CCPS horn speaker for a sealed rear chamber case.

FIG. 8 is the predicted SPL (at 1 meter) of the CCPS horn speaker system in accordance with the first embodiment of the present invention, showing the acoustic response of the CCPS horn speaker employing four 3 inch size mid-range drivers and a HF driver with an acoustic crossover frequency of approximately 1100 Hz. The dark trace represents the combined MF and HF driver output; the dark grey trace represents the MF driver output; and the light grey trace represents the HF driver output. This particular case is for a 45 degree expansion main horn and is calculated for the maximum linear excursion of the mid-range drivers which occurs at a drive voltage of 32 volts. Note that the acoustic output is 127 dB +/−3 dB over the range of 320 Hz to 20 kHz.

Figure 9:
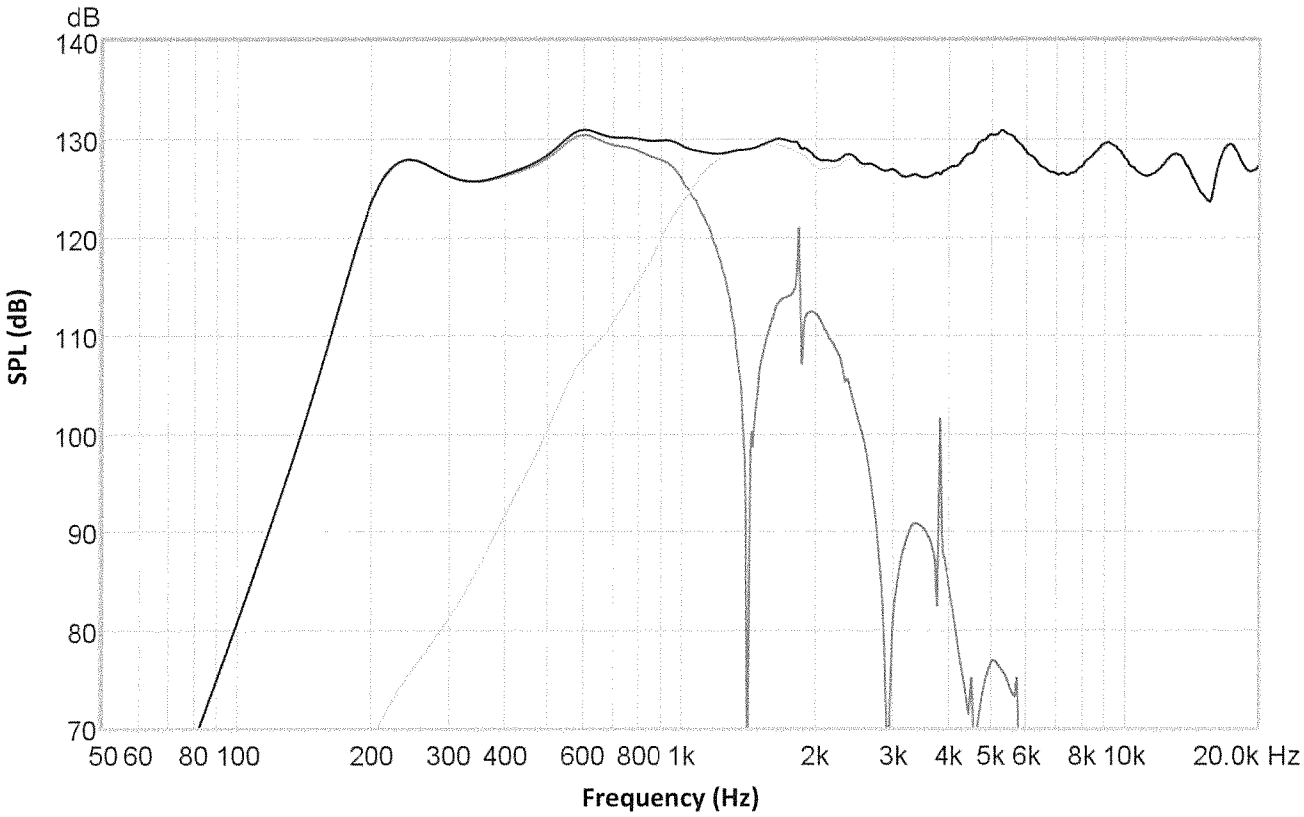
FIG. 9 is a graph illustrating a simulation of the CCPS horn speaker for a bass reflex rear chamber case.

FIG. 9 is the predicted SPL (at 1 meter) of the CCPS horn speaker system in accordance with the second embodiment of present invention that utilizes a bass reflex duct on the centerbody 10. The predicted acoustic response of the CCPS horn speaker is similar to the plot from FIG. 7 but with a 2.5 in diameter×3.0 in long bass reflex duct exiting near the periphery of the tail of the centerbody. The dark trace represents the combined MF and HF driver output; the dark grey trace represents the MF driver output; and the light grey trace represents the HF driver output. Notice now that the −3 dB point of the response is at 200 Hz and with a substantial +5 dB gain at 240 Hz.

Figure 10:
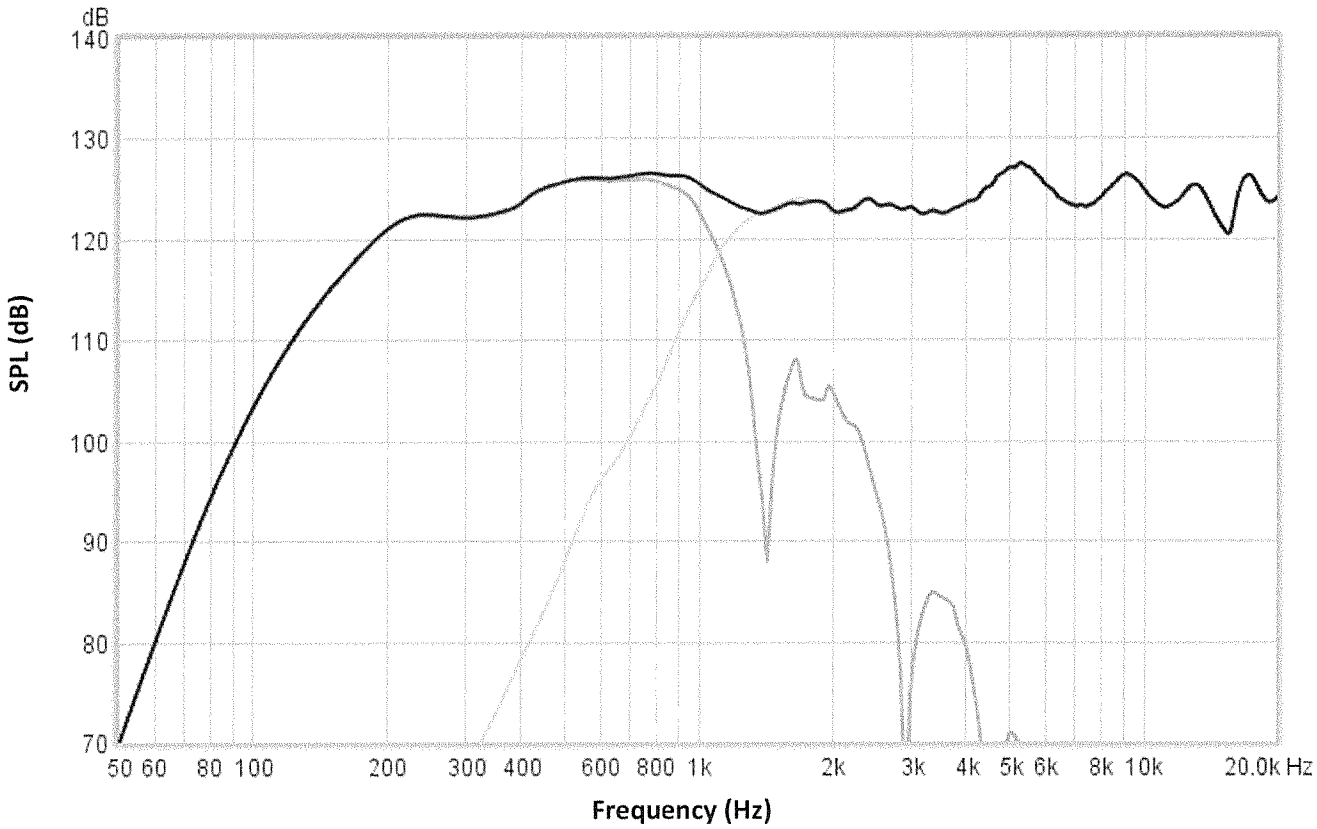
FIG. 10 is a graph illustrating a simulation of the CCPS horn speaker for a toroidal ring resonator with feedback duct topology case.

FIG. 10 is the predicted SPL (at 1 meter) of the CCPS horn speaker system in accordance with fourth embodiment that utilizes the Bisset and Nguyen (U.S. Pat. No. 9,479,861 B2) topology which provides a ring resonator and feedback duct as shown in FIG. 5, showing the acoustic response of the CCPS horn speaker employing four 3 inch size mid-range drivers and a HF driver with an acoustic crossover frequency of approximately 1100 Hz. The dark trace represents the combined MF and HF driver output; the dark grey trace represents the MF driver output; and the light grey trace represents the HF driver output. This particular case is for a 45 degree expansion main horn and is calculated for the maximum linear excursion of the mid-range drivers which occurs at a drive voltage of 24 volts. Note that the low frequency acoustic output is enhanced with a deeper low frequency reach below 150 Hz.

Figure 11:
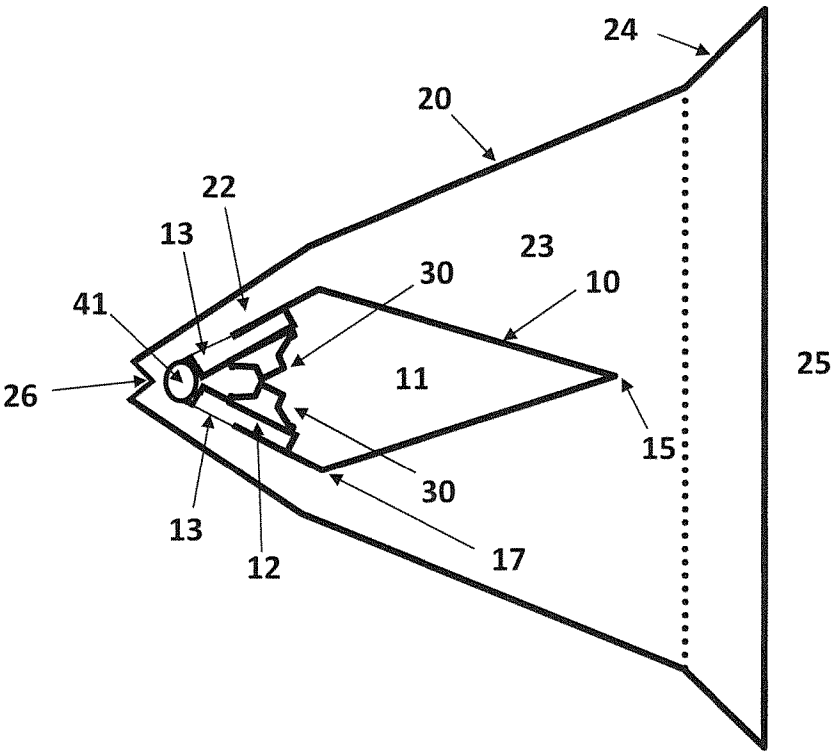
FIG. 11 is side schematic representation of a CCPS horn speaker system employing a high frequency tweeter mounted inside the centerbody.

FIG. 11 is a side view of a sixth embodiment of the CCPS horn speaker system where the high frequency tweeter 41, is located at the proximal vertex of the centerbody 10 such that all the acoustic drivers are now housed in the centerbody 10. A compact tweeter such as, but not limited to, a dome type may be used here. The outer horn vertex 26 is now re-curved with a convex cusp aimed at the tweeter 41 to help re-direct the high frequency sound. This particular embodiment provides enhanced ease of manufacturing and field serviceability.

Figure 12:
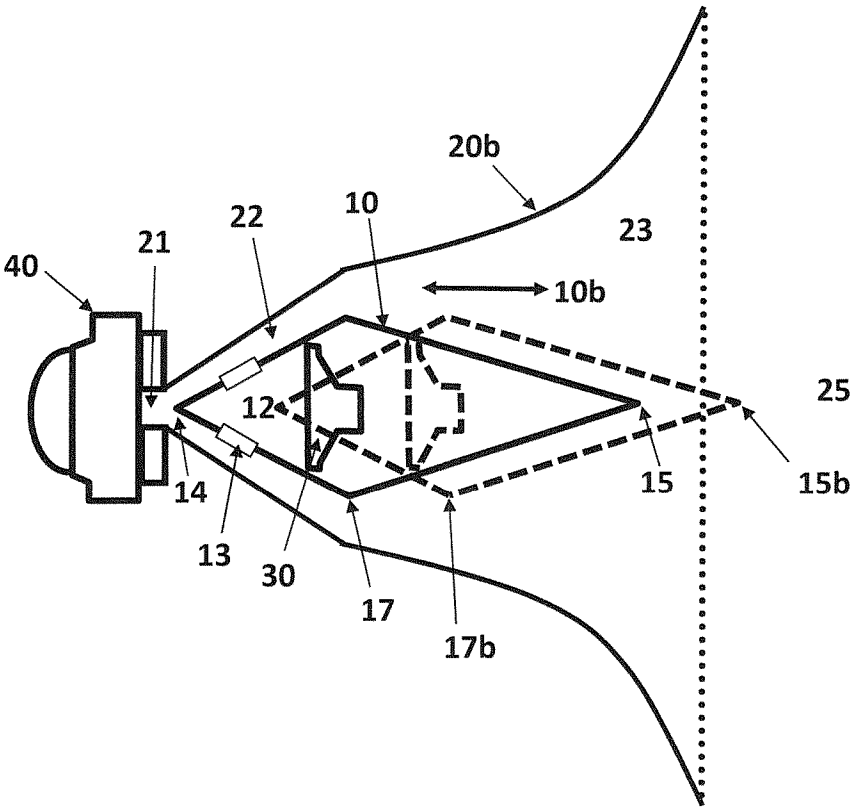
FIG. 12 is a side schematic of a representation of a CCPS horn speaker system that employs an axially translating centerbody to effect an in-situ variable directivity acoustic output.

FIG. 12 shows a seventh embodiment of the CCPS horn speaker system where the centerbody 10 is provided with a means to translate axially (shown by arrow 10*b*), and in conjunction with a specifically designed horn exterior sidewall 20*b*, a continuously variable directivity horn radiation pattern can be obtained. Translation of the centerbody 10 can be seen as the dashed lines which show a new axial position for the centerbody apex 17*b*, and centerbody distal vertex 15*b*. The use of a combination of curved and flat opposing horn wall channels permits a constant directivity horn that has reduced resonance peaks. Varying mechanisms can be used to accomplish the axial translation of the centerbody 10 and include for example, comprising spring loaded support or spider vanes which interact with the horn sidewall to hold the centerbody in place and which can be manipulated to change the location, or motorized support means to mechanically vary the centerbody location.

The invention further relates to a multi-driver horn that can be arrayed or clustered without any angular gaps around a 360° polar radiation pattern because it lacks drivers on the exterior horn wads which provide a closely spaced radial arrangement. As. As all of the drivers can be fitted inside the centerbody, the present invention allows the outer horn walls of one horn to align flush with the outer horn wall of another horn thus permitting a virtually seamless transition between horns in a radial array. Such horns could physically conform to 30°, 45°, 60°, or even 90° footprints. In other words, the use of a centerbody fitted with drivers permits a low profile exterior that allows close-placement of horns in a polar array via stacking the horns in a radial pattern equal to its coverage angle, typically in convenient increments of 30°, 45°, or 60°.

The present invention further relates to a focal point or field of acoustic "lensing" by mechanically moving the centerbody along the axis of horn. The axial movement of the centerbody may be employed to effect the acoustic lensing of the output radiation pattern in a way analogous to the focus and zoom features in an optical lens for a camera: the "sweet spot" of the radiation may be adjusted (focus feature) to a certain distance, or the coverage angle of the radiation pattern may be adjusted wider or narrower (zoom feature). The present invention allows improved coupling of mid-bass and bass frequencies by fully incorporating a ring resonator into a mid and high-frequency horn which typically demands the horn have a faster axial expansion rate to support HF directivity while the ring resonator topology typically requires the horn profile to expand at a slower rate in order to accomplish good LF acoustic coupling. In, the present invention it is recognized that the annular area is a suitable location to couple a ring resonator's feedback duct and achieve horn loading of mid-bass and bass acoustic energy. Thus, the invention accomplishes a ring resonator top horn that has extended mid-bass bandwidth without compromised directivity. While in accordance with the patent statutes the best mode and preferred embodiment have been set forth, the scope of the invention is not limited thereto, but rather by the scope of the attached claims.

What claimed is:

1. An acoustic horn comprising an acoustic enclosure extending along a longitudinal axis, the acoustic enclosure having an acoustically open end, an acoustically closed end, and acoustically closed narrowing sides having interior walls and;

an elongated centrally-located central member having an exterior wall, and a distal vertex and a proximal vertex, the centerbody containing one or more acoustic transducers and one or more acoustic ports, the centerbody extending along the longitudinal axis and the narrowing sides of the enclosure to form an annular acoustic channel defined by the interior walls of the acoustic enclosure and by the exterior walls of the centerbody, at least one high frequency range driver being acoustically coupled to the proximal vertex of the centerbody; and the centerbody having a rear surface, the rear surface coupled to the narrowing sides, and the centerbody further having a frontal surface, wherein the centerbody extends along the longitudinal axis in a first plane and in a second plane, and the second plane is inclined relative to the first plane, and in the first plane and in the second plane, the rear surface tapers outward along the longitudinal axis following a surface of the enclosure to a transition, and the first front surface tapers inward along the longitudinal axis from the transition toward the open end, so as to form an expanding annular passage defined by the acoustic enclosure and the centerbody exterior wall.

2. The acoustic horn of claim 1, wherein the acoustic enclosure includes a horn channel which is an expanding annular horn channel and the centerbody contains one or more ports, apertures or holes which are coupled to the expanding annular horn channel on one of the frontal surface or the rear surface or both the frontal and the rear surfaces.

3. The acoustic horn of claim 2, wherein the centerbody optionally includes one or more wide bandwidth woofers which operate in the range of 30 Hz to 5 kHz; and the centerbody includes one or more mid-range driver which operate in the range of 100 Hz to 6 kHz, each individually coupled to one or more opening comprising a port, a ducts or an aperture, the opening in communication with the horn channel;

the centerbody contains one or more wide bandwidth woofers which operate in the range of 30 Hz to 5 kHz coupled to one or more opening in communication with the horn channel; and the centerbody contains one or more mid-range drivers which operate in the range of 100 Hz to 6 kHz coupled to one or more opening in communication with the horn channel.

4. The acoustic horn of claim 3, wherein the centerbody frontal surface has a conclusion and the centerbody contains a bass reflex chamber serving one or more drivers, and venting into the horn channel through a port at the conclusion of the frontal surface.

5. The acoustic horn of claim 1, further comprising a ring resonator and a feedback duct and the acoustic channel having an acoustic channel port, and wherein the centerbody contains a back chamber in communication with the ring resonator and in communication with the feedback duct which is in communication with the acoustic channel.

6. The acoustic horn of claim 1, wherein the acoustic enclosure comprises a horn channel and the centerbody contains a dual chamber reflex configuration in communication with one or more driver and venting into the horn through a port at the conclusion of the first frontal surface.

7. The acoustic horn of claim 1, wherein the centerbody frontal surface has a conclusion, and the centerbody contains a band-pass-6 chamber serving one or more driver and venting into the horn through a port at the conclusion of the first frontal surface.

8. The acoustic horn of claim 3, wherein each of the centerbody and the acoustic enclosure have an interior and an exterior and one or more of the mid-range driver and the wide bandwidth woofer is located outside of the interior of each of the centerbody and the acoustic enclosure and are in communication with the centerbody interior, and ports therein through a duct intersecting the acoustic enclosure interior and the centerbody interior.

9. The acoustic horn of claim 1, wherein the exterior wall of the central member is not flat.

10. The acoustic horn of claim 9, wherein the exterior wall of the central member is curved.

11. The acoustic horn of claim 10, wherein the horn channel includes a mouth and the centerbody exterior wall has a bulging profile along the sagittal plane of the centerbody along its axial direction, following a form that is derived from theory or computer models to effect additional control of the polar directivity pattern of the sound field emanating from the mouth of the horn channel.

12. The acoustic horn of claim 8, wherein the acoustic enclosure comprises a horn channel and the horn channel has a horn speaker and the acoustic enclosure exterior is elongated in one direction perpendicular to the direction of the longitudinal axis such that the horn speaker has an aspect ratio in the one direction that is equal to or greater than 2:1.

13. The acoustic horn of claim 12, wherein the aspect ratio is equal to or greater than 4:1.

14. The acoustic horn of claim 8, wherein the acoustic enclosure comprises a horn channel and wherein the horn channel has a horn channel vertex and further comprising a compression driver used in the direction of the horn channel vertex.

15. The acoustic horn of claim 8, further comprising more than one mid-range drivers used along the exterior wall of the centerbody.

16. An acoustic horn of claim 8, which comprises a tall line-array speaker.

17. The acoustic horn of claim 8, wherein the exterior of the centerbody has a shape including a proximal end, and the shape of the proximal end of the centerbody is adjacent to a high frequency driver which transmits sound waves and is contoured as a phase plug in order to direct sound waves from the high frequency driver into an expanding annular horn channel so as inhibit destructive interference of the high frequency driver sound waves that would result in a frequency response dip.

18. The acoustic horn of claim 1, wherein the rear surface of the centerbody is coupled to the narrowing sides of the acoustic enclosure by one or more of porous acoustically diffuse material or vanes or a mechanically coupled electromagnetic field.

19. The acoustic horn of claim 1, wherein the annular acoustic channel has a profile that is triangle, square, polygon, circular, or elliptic.

20. The acoustic horn of claim 1, wherein the annular acoustic channel has a profile that varies parametrically in the axial and azimuthal coordinates to provide a spiral path expansion profile that serves to reduce circumferential or other destructive acoustic interference modes.

21. The acoustic horn of claim 1, wherein the annular acoustic channel includes a mouth and has a profile that varies parametrically in the axial and azimuthal coordinates to provide an expansion profile following a form that is derived from theory or computer models to effect additional control of a polar directivity pattern of a sound field emanating from the mouth of the annular acoustic channel.

22. The acoustic horn of claim 1, wherein the annular acoustic channel has a profile that varies parametrically in the axial and azimuthal coordinates to provide an expansion profile of a spiral path that serves to increase an acoustic path length of the annular acoustic channel relative to a purely axial expansion length.

23. The acoustic horn of claim 1, wherein the centerbody defines a volume and further comprising a high frequency transducer and wherein the centerbody includes the high frequency transducer located at the proximal vertex of the centerbody to provide a means for all drivers to be located within the centerbody volume.

24. The acoustic horn of claim 18, which allows all drivers to be replaced by removal of the centerbody from the annular acoustic channel.

25. The acoustic horn of claim 1, wherein the annular acoustic channel includes a mouth and which defines an expansion profile and wherein the centerbody is provided with a means to be axially translated to effect a variation in the expansion profile following a form that is derived from theory or computer models, so as to enable in-situ control of a polar directivity pattern of a sound field emanating from the mouth of the annular acoustic channel.

26. The acoustic horn of claim 1, wherein the centerbody is provided with a means of mechanical positioning along the longitudinal axis to effect a variation in the expansion profile and act as an acoustic lens for changing the focus or field width of an acoustic energy.

27. The acoustic horn of claim 1, including an outer horn boundary having inside surfaces at intervals and wherein the centerbody has alternating curved and flat surfaces at intervals which are opposite to the inside surfaces of the outer horn boundary thereby producing a constant rate expansion from a non-linear centerbody and horn inside surface relationship.

28. The acoustic horn of claim 1, wherein the acoustic enclosure comprises a horn channel and having an injection point in a narrowed aspect ratio horn channel so as to reduce destructive acoustic interference.

29. The acoustic horn of claim 27, wherein the centerbody includes curved and flat surfaces are radially symmetrical.

30. The acoustic horn of claim 1, wherein the centerbody can be translated along the longitudinal axis.

31. The acoustic horn of claim 30, whereby the location of the centerbody along the longitudinal axis changes the angle of dispersion of a sound of the acoustic horn.

32. An acoustic horn comprising an acoustic enclosure extending along a longitudinal axis, the acoustic enclosure having an acoustically open end, an acoustically closed end, and acoustically closed narrowing sides having an interior wall and;

an elongated centrally-located central member having an exterior wall including alternating segments, and a distal vertex and a proximal vertex, the central member containing one or more acoustic transducers and one or more acoustic ports, the central member extending along the longitudinal axis at a variable location and within the narrowing sides of the acoustic enclosure to form an annular acoustic channel defined by the interior wall of the acoustic enclosure and by the exterior wall of the central member, at least one high frequency range driver being acoustically coupled to the proximal vertex of the central member; and the central member having a rear surface, the rear surface coupled to the narrowing sides, and the central member further having a frontal surface, wherein the central member extends along the longitudinal axis in a first plane and in a second plane, and the second plane is inclined relative to the first plane, and in the first plane and in the second plane, the rear surface tapers outward along the longitudinal axis following a surface of the interior wall of the acoustic enclosure to a transition, and the first front surface tapers inward along the longitudinal axis from the transition toward the open end so as to form an expanding annular passage defined by the interior wall of the acoustic enclosure and the central member exterior wall.

33. The acoustic horn of claim 32, wherein the segments of the central member body alternate between a curved profile and a flat profile.

34. The acoustic horn of claim 33, wherein the interior walls of the acoustic enclosure are segments which alternate between a curved profile and a flat profile and a flat segment of the central body opposes a curved segment of the acoustic enclosure interior wall.

35. The acoustic horn of claim 1, wherein the horn includes an acoustic energy having a focus and field width and an axial expansion with an expansion profile and the centerbody is provided with a means of mechanical positioning along the axial expansion to effect a variation in the expansion profile and act as an acoustic lens for changing the focus and the field width of the acoustic energy.

36. The acoustic horn of claim 1, wherein the centerbody exterior wall includes surfaces that are alternating curved and flat surfaces and the acoustic enclosure interior wall includes surfaces that are alternating flat and curved and the surfaces alternate at opposite intervals to the surfaces of the acoustic enclosure so as to produce a constant rate expansion from a non-linear centerbody and acoustic enclosure relationship.

* * * * *